US005651236A

United States Patent [19]

O'Neill

[11] Patent Number: 5,651,236

[45] Date of Patent: Jul. 29, 1997

[54] PACKAGING OF ARTICLES

[75] Inventor: James Michael O'Neill, Durbanville, South Africa

[73] Assignee: Metal Box South Africa Limited, Atholl Gardens, South Africa

[21] Appl. No.: 285,793

[22] Filed: Aug. 4, 1994

[30] Foreign Application Priority Data

Aug. 11, 1993 [ZA] South Africa ..... 93/5845

[51] Int. Cl.[6] ..... B65B 5/10

[52] U.S. Cl. ..... 53/469; 53/447; 53/413

[58] Field of Search ..... 53/413, 438, 444, 53/447, 459, 469, 480, 481, 149, 236, 479

[56] References Cited

U.S. PATENT DOCUMENTS

| | | | |
|---|---|---|---|
| 3,587,201 | 6/1971 | Strayer | 53/438 |
| 3,660,959 | 5/1972 | La Fleur | 53/469 |
| 4,679,379 | 7/1987 | Cassoli | 53/447 |
| 4,919,265 | 4/1990 | Lems et al. . | |
| 5,022,216 | 6/1991 | Muckenfuhs et al. | 53/438 |
| 5,381,643 | 1/1995 | Kazaitis | 53/444 |
| 5,391,108 | 2/1995 | Feldt | 53/444 |
| 5,570,567 | 11/1996 | Laubscher et al. | 53/447 |

FOREIGN PATENT DOCUMENTS

| | | |
|---|---|---|
| 2687/66 | 3/1966 | Australia . |
| 5593569 | 6/1969 | Australia . |
| 526454 | 5/1931 | Germany . |
| 2825800 | 9/1979 | Germany . |
| 900833 | 7/1962 | United Kingdom . |

*Primary Examiner*—Daniel Moon
*Assistant Examiner*—John Paradiso
*Attorney, Agent, or Firm*—James Ray & Associates

[57] ABSTRACT

A pack 10 of bottles 14 comprises a plurality of layers 12. Each layer 12 has its bottles 14 packed in a close packed side-by-side array, the array being hexagonal. The layers 12 are packed in a sleeve 18 of a plastics material. The sleeve 18 is selected to have a perimetral dimension slightly less than a peripheral dimension of each layer 12 such that the layers 12, once packed in the sleeve, are constrained against movement.

13 Claims, 2 Drawing Sheets

PACKAGING OF ARTICLES

FIELD OF THE INVENTION

THIS INVENTION relates to the packaging of articles. More particularly, the invention relates to a method of packaging articles and to a pack of articles.

The articles in question are cylindrical articles which can stand, unsupported, on their ends. The invention has particular application in the packaging of lightweight plastics bottles.

SUMMARY OF THE INVENTION

According to a first aspect of the invention there is provided a method of packaging cylindrical articles, the method including the steps of forming a first layer by arranging the articles side-by-side in a polygonal format with articles in one row of said polygon nesting in recesses formed by adjacent articles in an adjacent row to form a substantially stable polygon; and forming at least one further layer, in the same manner as the first layer, on the first layer to form a cylindrical stack of polygonal end profile, with articles in each layer of the stack being loose.

Hence, the method may include providing a holder and packing the layers in the holder.

Preferably, the method includes forming each layer outside the holder and, thereafter, placing each formed layer, the articles in said layer being loose, in the holder.

In this specification, the term "loose" means that the articles in each layer are not tied together in any manner. In use, the articles in each layer are merely held together in the required configuration by the holder.

To maintain the integrity of the completed stack, the method may include selecting a holder having an internal peripheral dimension less than that of an external peripheral dimension of each layer. Hence, the method may include compressing each layer peripherally in order to place it in the holder. In effect, each layer is "extruded" through a device which compresses it peripherally to facilitate insertion of the layer in the holder.

The holder may be a sleeve of a flexible material and the method may then include closing off one end of the sleeve, packing the layers in the holder and closing off an opposed end of the sleeve.

The method may include, as an initial step, closing off said one end of the sleeve by forming an end seal in the end of the sleeve prior to packing the layers in the sleeve. Then, the method may include forming the end seal with an end portion having a length dimension less than a lay flat width of the sleeve.

In this specification, the term "lay flat width" means half a perimetral dimension of the sleeve and "lay flat form" has a corresponding meaning.

The method may include forming side portions, one at each end of the end portion, each side portion tapering inwardly from a side edge of the sleeve, in its lay flat form, to the end portion to form a substantially gable-shaped seal in the end of the sleeve. It will be appreciated that the side portions and the end portion are formed simultaneously in a one-piece operation.

After conclusion of the packing of the layers and closing off said opposed end of the sleeve, the method may include fastening flap portions, formed by excess material as a result of distortion of the gable-shaped seal when the layers are packed in the sleeve, together to form a handle for carrying the pack. The flap portions may be fastened in any suitable manner, for example, by taping the ends together, by tying them together, or the like.

After completion of the packing of the layers into the sleeve, the method may include closing off the opposed end of the sleeve by forming a bottom seal extending across the full width of the sleeve. To enhance the rigidity of the pack, the method may also include tying loose ends of the bottom seal together to tension that region of the sleeve below the operatively lowermost layer of articles.

The applicants have found that the most stable structure which can be achieved is a hexagonal structure. Hence, in a preferred embodiment of the invention, the method may include packing each layer in a hexagonal format.

According to a second aspect of the invention, there is provided a pack of cylindrical articles, the pack including a first layer of articles arranged side-by-side such that articles in one row are received in recesses formed by adjacent articles in an adjacent row in a substantially stable polygonal format; and at least one further layer of the same polygonal format formed on said first layer to form a cylindrical stack of polygonal end profile.

The pack may include a holder in which the layers, the articles being loose, as defined, are packed.

Preferably, the holder has an internal peripheral dimension less than an external peripheral dimension of each layer, prior to insertion of said layer into the holder.

The holder may be a sleeve of a flexible material which envelops the packed articles. Preferably, the holder is in the form of a sleeve or tube of synthetic plastics material.

An end of the sleeve, prior to insertion of the layers, may be closed off by an end seal. The end seal may have an end portion having a length less than a lay flat width, as defined, of the sleeve. Further, the end seal may have a side portion extending from each end of the sleeve to a corresponding side edge of the sleeve, in its lay flat form, such that an included angle between the end portion and each side portion is an obtuse angle to form a substantially gable-shaped seal.

In a preferred embodiment of the invention, the end portion of the end seal may have a length which is approximately ⅔ that of the lay flat width of the sleeve. Each side portion may have a length which is approximately ⅓ the lay flat width of the sleeve. Thus, it will be appreciated that the included angle between the end portion and each side portion is approximately 120°.

Flap portions, defined by excess material of the gable-shaped seal due to distortion of the seal on insertion of the packed layers into the sleeve, may be fastened together to form a handle.

Still further, the pack may include a bottom seal extending the full width of the sleeve, the bottom seal having been formed after the packing of the layers into the sleeve.

Both the end seal and the bottom seal may be formed by a heat welding operation.

Each layer may be in the form of a polygon where the polygon has an included angle between at least certain adjacent sides of greater than 90° with the sum of the included angles being a multiple of 360°.

Each layer may be hexagonal in shape. The hexagonal structure may either be a regular hexagon where each side is of equal length or it may be an irregular hexagon in which adjacent sides differ in length.

In use, due to the compression of the articles prior to insertion into the sleeve, the articles are packed in the hexagonal shape in a close packed formation. This ensures that relative movement between adjacent articles in a layer and between the layers is minimised to provide a stable stack.

In the case of a regular hexagon, the total number of articles in a single layer of the pack may be given by the formula:

$$N=3n^2-3n+1$$

where N is the number of articles in a layer and n is the number of articles per side.

Further, the length of a side of any hexagonal pack irrespective of whether that pack is a regular hexagon or not is given by the formula:

$$(n-1)\phi+0{,}577\phi$$

where N is the number of articles per side and $\phi$ is the external diameter of such article.

The applicant has found that, with this configuration of package, the resulting structure is extremely stable and can be manhandled without significant damage being caused to the articles constituting the package or to the integrity of the package itself.

According to yet a further aspect of the invention, there is provided a holder in which articles are packable, the holder including a sleeve of a resiliently flexible material; and an end seal defined in an end of the sleeve to close off the end, the end seal having an end portion which has a length less than a lay flat width of the sleeve.

The end seal may have a side portion extending from each end of the end portion to a corresponding side edge of the sleeve, in its lay flat form, such that an included angle between the end portion and each side portion is an obtuse angle to form a substantially gable-shaped seal.

The length of the end portion may be approximately ⅔ of the lay flat width of the sleeve and the length of each side portion may be approximately ⅓ of the lay flat width of the sleeve. Then, it will be appreciated that the included angled will be approximately 120°.

The sleeve may be of a synthetic plastics material. More particularly, the sleeve may be of a polyethylene material. In a preferred form of the invention, the sleeve is a blend of linear low density polyethylene and high density polyethylene.

BRIEF DESCRIPTION OF DRAWINGS

The invention is now described by way of example with reference to the accompanying diagrammatic drawings.

In the drawings.

DETAILED DESCRIPTION OF DRAWINGS

Figure 1:
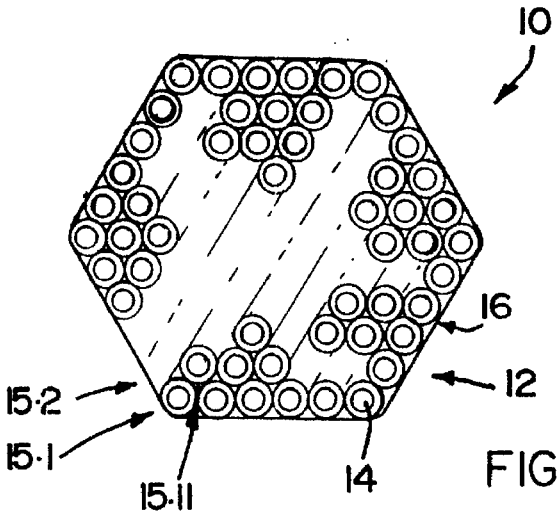
FIG. 1 shows a plan view of a pack of articles, in accordance with the invention.

Referring to the drawings, a pack of articles, in accordance with the invention, is illustrated and is designated generally by the reference numeral 10.

The pack of articles 10 comprises a plurality of layers 12 (FIGS. 2 and 3) of articles in the form of cylindrical bottles 14 which can stand, unsupported, on their ends. Each layer 12 has its bottles 14 packed in a close packed side-by-side array and each layer 12 is in the form of a polygon. As illustrated, each layer 12 is in the form of a hexagon. The hexagon may either be a regular hexagon where each side 16 of the hexagon is of the same length or it may be in the form of an irregular hexagon where adjacent sides differ in length. The hexagon is a stable structure and it is to be noted that bottles 14 in one row 15.2 of each layer 12 nest in recesses 15.11 formed by adjacent bottles 14 in an adjacent row 15.1.

In the case of a regular hexagon, the number of bottles 14 in any one layer 12 is given by the formula:

$$N=3n^2-3n+1$$

where N is the number of bottles 14 per layer and n is the number of bottles per side 16. An example of this is for a layer 12 which is a regular hexagon having 10 bottles per side where there will be 271 bottles in the layer 12.

The length of any side 16 of any layer 12, irrespective of whether the hexagon constituting the layer 12 is a regular hexagon or not, is given by the formula:

$$(n-1)\phi+0{,}577\phi$$

where n is the number of bottles per side and $\phi$ is the external diameter of the bottle 14. In the above example, if the diameter of each bottle 14 is 50 mm, the length of that side will be approximately 480 mm.

The pack 10 includes a holder or sleeve 18 in which the layers 12 are packed. The sleeve 18 is of a synthetic plastics material such as, for example, polyethylene tubing. The sleeve 18 is specified by its parameters such as its lay flat width, length of sleeve, type of material or blend of materials and thickness of the sleeve 18.

For a regular hexagon the lay flat width of the sleeve 18 is calculated as being approximately three times the length of the side 16 of a layer 12, or half the perimetral dimension of the sleeve 18. For an irregular hexagon, the lay flat width of the sleeve 18 is approximately the sum of three adjacent sides or, once again, half the perimetral dimension of the sleeve 18. The other parameters of the sleeve 18, such as choice of material, length and thickness are dictated by external factors such as the weight of the pack 10, distance to be transported, transport means, etc. The sleeve 18 is selected to have a perimetral or circumferential dimension which is slightly less than an outer peripheral dimension of each layer 12.

In use, the sleeve 18 is held in an open position and an operatively bottom opening of the sleeve 18 is closed off in a suitable manner, for example, by being tied as shown schematically at 20 in the drawings. The formation of the tie 20 can be effected in any suitable way, for example, a mechanical tie system such as a cable tie, wire tie, tape tie, or a knot being made within the material of the sleeve 18.

After the tie 20 has been formed, the first layer 12.1 is formed outside the sleeve 18. The formed layer 12.1 is compressed peripherally to a predetermined extent and is then inserted into the sleeve 18. Once in the sleeve 18 the layer 12.1 expands slightly to stretch the sleeve 18. In so doing the layer 12.1 is held in position by the sleeve 18. The layer 12.1 is packed in a close-packed side-by-side array such that bottles 14 in one row 15.1 nest in the recesses 15.11 formed between adjacent bottles 14 in an adjacent row 15.2 as illustrated in FIG. 1 of the drawings.

Second and subsequent layers 12.2 to 12.4 are thereafter formed and placed in the sleeve 18 above the first layer 12.1 in a similar fashion to that described above.

Figure 2:
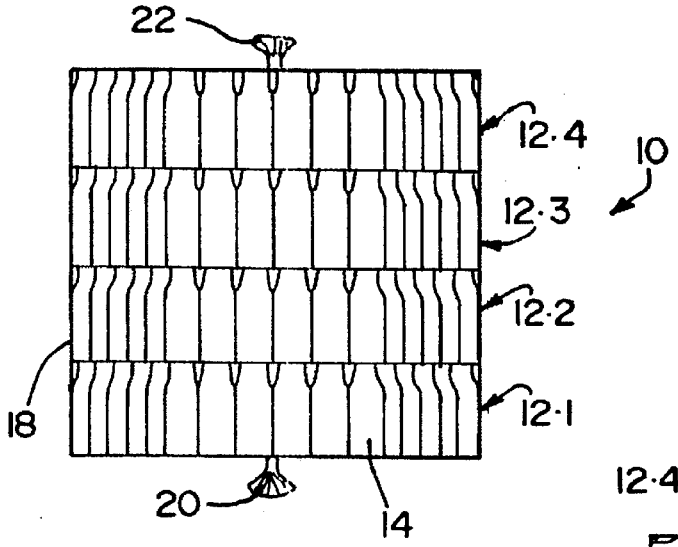
FIG. 2 shows a front view of the pack.
Figure 3:
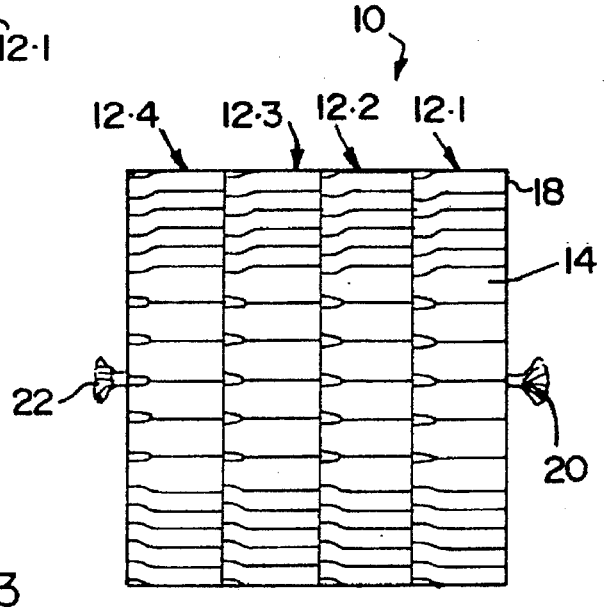
FIG. 3 shows a side view of the pack, resting on one side.

An operatively top opening of the sleeve 18 is then closed off in a similar manner to the bottom, as illustrated schematically at 22 in FIGS. 2 and 3 of the drawings.

It will be appreciated that, instead of a tie 20, 22, the top and bottom openings of the sleeve 18 could be closed off in other ways, for example, by heat welding.

Figure 4:
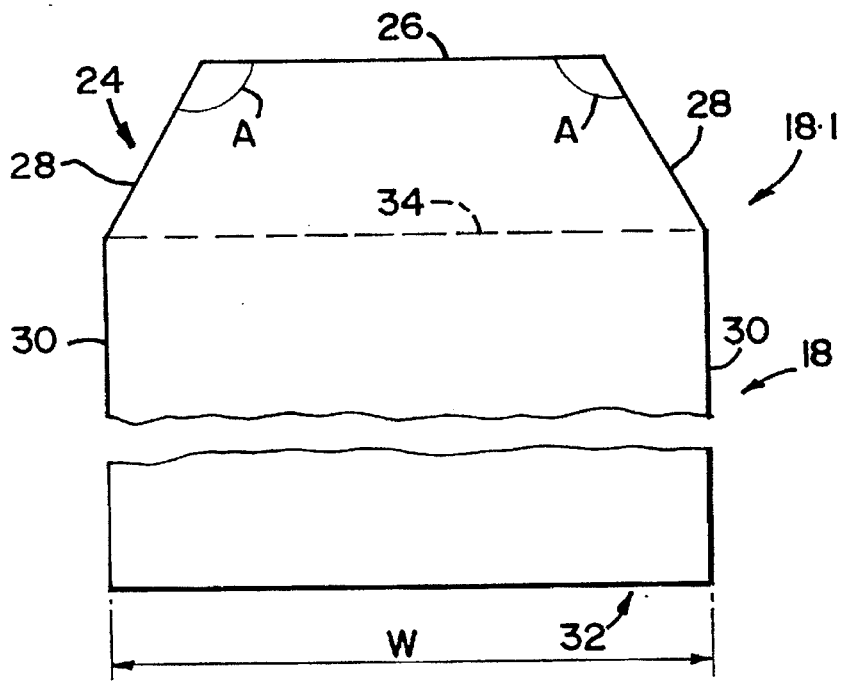
FIG. 4 shows a side view of a sleeve, in accordance with a development of the invention, for the pack of articles.
Figure 5:
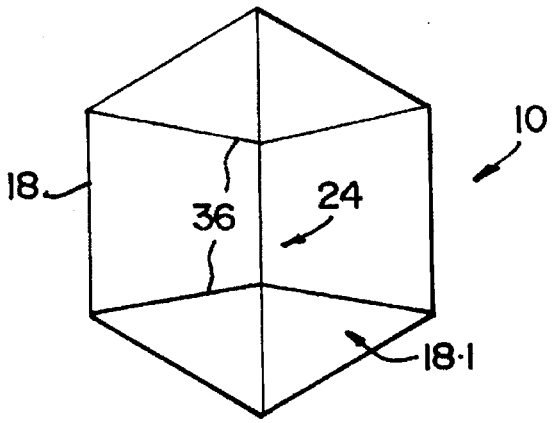
FIG. 5 shows a plan view of the sleeve of FIG. 4, once it has been packed with the articles.
Figure 6:
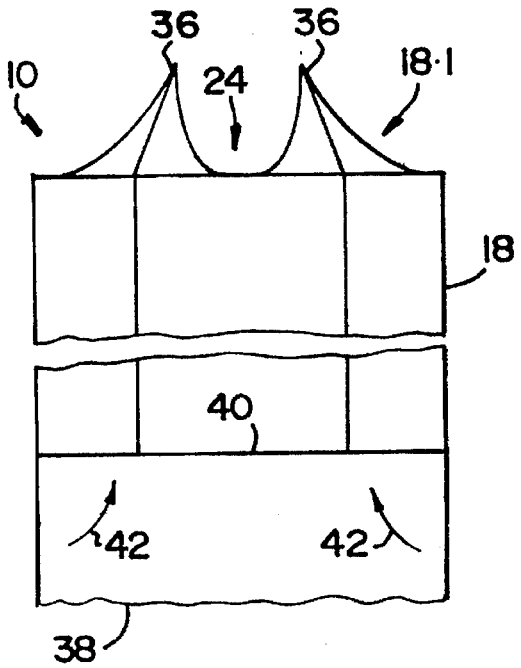
FIG. 6 shows a side view of the packed sleeve of FIG. 4.

Referring now to FIGS. 4 to 6 of the drawings, a development of the invention is illustrated. With reference to the previous drawings, like reference numerals referred to like parts, unless otherwise specified.

In this embodiment of the invention, the sleeve 18 is of a polyethylene blend. More particularly, the sleeve 18 is a blend of linear low density polyethylene and high density polyethylene. The actual blend used will be dependant on the application of the sleeve 18.

An end of the sleeve 18 is closed of by an end seal 24. The end seal 24 will be arranged at an operatively top region of the finished pack 10, as will be described in greater detail below. The end seal 24 has an end portion 26 which extends at substantially right angles to a longitudinal axis of the sleeve 18. The length of the end portion 26 is approximately ⅔ the lay flat width W of the sleeve 18. The end seal 24 further has side portions 28. A side portion 28 of the end seal 24 extends from each end of the end portion 26 to an associated side edge 30 of the sleeve 18 to form a substantially gable-shaped seal at the end of the sleeve 18. The length of each side portion 28 is selected to be approximately ⅓ the lay flat width W of the sleeve 18. As indicated above, the lay flat width W of the sleeve is slightly less than the length of three sides of a layer 12.

It will be appreciated that the end portion 26 and the side portions 28 are formed in a single operation by heat welding.

Further, with the dimensions of the end portion 26 and the side portions 28, as described above, an included angle A between the end portion 26 and each side portion 28 is approximately 120°.

Further, it will be appreciated that the end seal 24 is formed in the end of the sleeve 18 before the layers 12 of bottles 14 are packed in the sleeve 18.

Thus, in use, as described above, each layer 12 of bottles 14 is formed outside the sleeve 18. Once again, the circumferential dimension of the sleeve 18 is selected to be slightly less than the peripheral dimension of each layer 12 such that the layer 12 must be compressed slightly before the layer 12 is inserted into an open end 32 of the sleeve 18.

The first layer 12 inserted into the sleeve 18 is inserted up to the dotted line 34 in FIG. 4 of the drawings. When the layers 12 are packed into the sleeve 18, a distortion of the gable-shaped end seal 24 is caused resulting in ears or flaps 36 being formed at the end 18.1 of the sleeve 18, as shown in greater detail in FIGS. 5 and 6 of the drawings.

The ends of these flaps 36 can be tied together in any appropriate manner, to serve as a handle for carrying or moving the pack 10.

Once the last layer, for example, layer 12.4 has been packed into the sleeve 18, a bottom seal 38 is formed in the sleeve to close off the bottom opening 32 of the sleeve 18. It will be appreciated that the bottom seal 38 is spaced from the bottom of the last layer, as illustrated schematically at line 40, by a predetermined amount and, further, that the bottom seal extends the full width W of the sleeve 18. Excess material of the sleeve 18 between the bottom 40 of the last layer 12 and the seal 38 is folded over, in the direction of arrows 42 to lie flat against the bottom 40 of the last layer 12 in the sleeve 18. When this excess material of the sleeve 18 is folded in the direction of the arrows 42, it imparts tension to that part of the sleeve 18 surrounding the bottom layer to maintain the rigidity of said last layer 12 in the sleeve 18.

With this configuration of sleeve 18 and end seal 24, when a hexagonal layer 12 is inserted into the sleeve 18, there is a natural tendency for the parts of the sleeve 18 at two opposite sides of the hexagonal layer to be pulled towards each other. Further, as described above, there is a natural tendency for the flaps 36 to be formed at the end 18.1 of the sleeve 18. By pulling these flaps 36 together, the end of the sleeve 18 is caused to adopt a natural hexagonal shape which is substantially the same size as that of the hexagonal layer 12 being packed.

Further, once the flaps 36 have been fastened together, the top of the pack 10 is substantially flat and no undue force is placed upon the corner bottles in the top most layer 12. This is further facilitated by the natural hexagonal shape which the sleeve 18 adopts when the seal 24 is distorted upon the insertion of the first layer 12 into the sleeve 18. The fact that no undue forces are placed upon the corner bottles is a surprising, significant advantage which is imparted to the finished pack 10 as the rejection of bottles 12 by bottle handling machinery is significantly reduced.

By having the bottles 14 in each layer 12 nesting in recesses 15.11 formed between adjacent bottles 14 of an adjacent row and, by having the layers 12 constrained against movement by the sleeve 18, a stable hexagon is provided. Also, it will be appreciated that, conventionally, a base of each bottle 14 has a recess therein in which a neck of a bottle 14 in a subjacent layer can be received in a nesting manner such that the stability of the pack 10 so formed is further improved.

Once completed, the pack 10 can either be stored on one of its ends, ie. as defined by the bases of the bottles 14 in the layer 12.1, or the necks of the bottles 14 in the layer 12.4, or on any side of the pack, as illustrated in FIG. 3 of the drawings.

In the case of a regular hexagonal shape, the packs 10 can be arranged in a honeycomb arrangement for storage purposes.

It is a particular advantage of the invention that a stable pack 10 is provided. The applicant has found that, with a pack 10 having a hexagonal outline, and packaged as described above the pack 10 can be manhandled without significant damage to the bottles 14 in each layer 12 being caused. This is especially so in respect of packs 10 using the sleeve 18 as described above with reference to FIGS. 4 to 6 of the drawings. In addition, the pack 10 can be relatively roughly handled without significant loss of shape of the pack 10 resulting. Also, the fact that the bottles 14 in each layer 12 are loose, as defined, facilitates the unpacking of the bottles 14 from the pack 10, particularly by an automatic unpacking machine.

I claim:

1. A method of packaging cylindrical articles, said method comprising the steps of:

(a) forming an unrestrained first layer of articles by arranging said articles side-by-side in rows in a polygon type format with articles in one row of said polygon type format nesting in recesses formed by adjacent articles in an adjacent row of said polygon type format to form a substantially stable polygon;

(b) forming at least one further unrestrained layer, in a same manner as said first layer; and (c) inserting said first layer and said at least one further layer into a flexible sleeve, said flexible sleeve having an unpleated substantially gable-shaped seal at one end thereof such that, when said first layer is inserted into said flexible sleeve, opposite sides of said end of said flexible sleeve have a tendency to be drawn towards each other so that said flexible sleeve holds said first layer and said at least one further layer in a cylindrical pack of polygonal end profile.

2. The method as claimed in claim 1 which includes placing each formed layer into said flexible sleeve with said articles of said layer being loose prior to insertion into said flexible sleeve.

3. The method as claimed in claim 2 wherein said method includes the additional step of selecting said flexible sleeve such that it exhibits an internal peripheral dimension less than that of an external peripheral dimension of each said layer prior to insertion of each said layer into said flexible sleeve.

4. The method as claimed in claim 3 wherein said method includes the additional step of compressing each said layer peripherally in order to place it in said flexible sleeve.

5. The method as claimed in claim 1 wherein said method includes the additional step of, after packing said layers into said flexible sleeve, closing off an opposed end of said flexible sleeve.

6. The method as claimed in claim 1 which includes forming said gable-shaped seal with an end portion, extending at right angles to a longitudinal axis of said flexible sleeve, with an end portion having a length dimension less than a lay flat width of said flexible sleeve.

7. The method as claimed in claim 6 which includes forming side portions, one at each end of said end portion, each side portion tapering inwardly from a side edge of said flexible sleeve, in its lay flat form, to said end portion to form said substantially gable-shaped seal in said end of said flexible sleeve.

8. The method as claimed in claim 7 which includes, after completion of the packing of the layers and closing off said opposed end of the sleeve, fastening flap portions, formed by excess material as a result of distortion of the gable-shaped seal when the layers are packed in the sleeve, together to form a handle for carrying the pack.

9. The method as claimed in claim 5 which includes, after completion of the packing of the layers into the sleeve, closing off said opposed end of the sleeve by forming a bottom seal extending across the full width of the sleeve.

10. The method as claimed in claim 1 which includes packing each layer in a hexagonal format.

11. The method as claimed in claim 7 which includes forming said end portion and said side portions together in one operation.

12. The method as claimed in claim 11 which includes forming said gable-shaped seal by heat welding said end of said flexible sleeve.

13. The method as claimed in claim 1 which, once said layers have been packed into said flexible sleeve, distortion of said end of said flexible sleeve occurs to form a pair of spaced flaps, said method including the additional step of fastening said flaps together to form a substantially flat end of the pack, thereby to inhibit the application of undue forces upon articles at corners in said first layer and to constrain said articles in each layer against movement.

* * * * *